US009404047B2

(12) United States Patent
Ito et al.

(10) Patent No.: US 9,404,047 B2
(45) Date of Patent: Aug. 2, 2016

(54) START-UP METHOD OF HYDROCARBON SYNTHESIS REACTION APPARATUS

(71) Applicants: Japan Oil, Gas and Metals National Corporation, Tokyo (JP); Inpex Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel & Sumikin Engineering Co., Ltd., Tokyo (JP)

(72) Inventors: Takeo Ito, Tokyo (JP); Atsushi Murata, Tokyo (JP); Eiichi Yamada, Tokyo (JP); Yuzuru Kato, Tokyo (JP); Yasuhiro Onishi, Tokyo (JP)

(73) Assignees: Japan Oil, Gas and Metals National Corporation, Tokyo (JP); INPEX CORPORATION, Tokyo (JP); JX Nippon Oil & Energy Corporation, Tokyo (JP); Japan Petroleum Exploration Co., Ltd., Tokyo (JP); COSMO OIL CO., LTD., Tokyo (JP); NIPPON STEEL & SUMIKIN ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 14/440,772

(22) PCT Filed: Nov. 6, 2013

(86) PCT No.: PCT/JP2013/080027

§ 371 (c)(1),
(2) Date: May 5, 2015

(87) PCT Pub. No.: WO2014/073575

PCT Pub. Date: May 15, 2014

(65) Prior Publication Data

US 2015/0267123 A1 Sep. 24, 2015

(30) Foreign Application Priority Data

Nov. 9, 2012 (JP) ..... 2012-247727

(51) Int. Cl.
*C07C 27/00* (2006.01)
*C10G 2/00* (2006.01)

(52) U.S. Cl.
CPC *C10G 2/32* (2013.01); *C10G 2/342* (2013.01); *C10G 2/344* (2013.01); *C10G 2300/4031* (2013.01)

(58) Field of Classification Search
CPC ..... C10G 2/344; C10G 2/32; C10G 2/342; C10G 2300/4031
USPC ..... 518/700, 712
See application file for complete search history.

(56) References Cited

U.S. PATENT DOCUMENTS

2003/0079867 A1* 5/2003 Chang ..... B01J 8/1836 165/133
2005/0027020 A1 2/2005 Steynberg (Continued)

FOREIGN PATENT DOCUMENTS

JP 2004-532966 A 10/2004
WO 02/100981 A1 12/2002

(Continued)

OTHER PUBLICATIONS

Int'l. Search Report issued on Feb. 10, 2014 in Int'l. Application No. PCT/JP2013/080027.

*Primary Examiner* — Jafar Parsa
(74) *Attorney, Agent, or Firm* — Panitch Schwarze Belisario & Nadel LLP

(57) ABSTRACT

A start-up method for a hydrocarbon synthesis reaction apparatus, comprising: an initial slurry-loading step in which the slurry is loaded into the reactor at the initial stage of the Fischer-Tropsch synthesis reaction at a lower loading rate than that applied to the reactor in a steady-state operation; and a CO conversion ratio-increasing step in which the liquid level of the slurry in the reactor is raised by adding to the slurry the hydrocarbons synthesized at the early stage of the Fischer-Tropsch synthesis reaction so that the CO conversion ratio is increased in proportion to a rise in the liquid level of the slurry in the reactor.

6 Claims, 5 Drawing Sheets

(56) References Cited

U.S. PATENT DOCUMENTS

| | | | |
|---|---|---|---|
| 2010/0242594 | A1 | 9/2010 | Onishi et al. |
| 2011/0210046 | A1 | 9/2011 | Tanaka et al. |

FOREIGN PATENT DOCUMENTS

| | | | |
|---|---|---|---|
| WO | 2009/041579 | A1 | 4/2009 |
| WO | 2010/038389 | A1 | 4/2010 |

* cited by examiner $T_1$: TEMPERATURE OF SLURRY IN INITIAL STAGE $T_2$: TEMPERATURE OF SLURRY IN EARLY STAGE $T_3$: TEMPERATURE OF SLURRY IN STEADY-STATE OPERATION

START-UP METHOD OF HYDROCARBON SYNTHESIS REACTION APPARATUS

CROSS-REFERENCE TO RELATED APPLICATION

This application is a Section 371 of International Application No. PCT/JP2013/080027, filed Nov. 6, 2013, which was published in the Japanese language on May 15, 2014, under International Publication No. WO 2014/073575 A1, the disclosure of which is incorporated herein by reference.

BACKGROUND OF THE INVENTION

1. Field of the Invention

The present invention relates to a start-up method of a hydrocarbon synthesis reaction apparatus.

Priority is claimed on Japanese Patent Application No. 2012-247727 filed on Nov. 9, 2012, the content of which is incorporated herein by reference.

2. Description of Related Art

In recent years, as a process for synthesizing liquid fuels from natural gas, the GTL (gas-to-liquids: liquid fuels synthesis) technique has been developed. This GTL technique includes the steps of reforming a natural gas to produce a synthesis gas containing carbon monoxide gas (CO) and hydrogen gas ($H_2$) as main components, synthesizing hydrocarbons using this synthesis gas as a feedstock gas and using a catalyst via the Fischer-Tropsch synthesis reaction (hereinafter also referred to as the "FT synthesis reaction"), and then hydrogenating and fractionating these hydrocarbons to produce liquid fuel products such as naphtha (raw gasoline), kerosene, gas oil and wax, and the like.

In a hydrocarbon synthesis reaction apparatus used in the GTL technique, a hydrocarbon is synthesized by FT synthesis reaction of carbon monoxide gas and hydrogen gas included in synthesis gas inside a reactor, which contains slurry having solid catalyst particles (cobalt catalyst and the like, for example) suspended in a liquid medium (liquid hydrocarbon and the like, for example).

FT synthesis reaction is an exothermal reaction and depends on temperature. The higher temperature is, the more FT synthesis reaction proceeds. In the case in which heat generated by the reaction is not removed, the temperature in the reactor increases rapidly by accelerating FT synthesis reaction, thereby causing thermal deterioration of the catalyst. The slurry is generally cooled via a heat exchanger tube by coolant flowing therethrough. In order to operate the reactor at a higher CO conversion ratio therein, wherein the CO conversion ratio is a ratio of an amount of CO expended in FT synthesis reaction to an amount of CO at an inlet of the reactor from which synthesis gas is introduced thereto, it is required to secure a large effective area of the heat exchanger tube, contacting with the slurry, for removing the heat from the slurry so as to cool the slurry efficiently. The heat exchanger tube is generally installed along the vertical direction of the reactor. Therefore, the effective area of the heat exchanger tube for removing the heat from the slurry depends on the liquid level of the slurry in the reactor. That is, the higher the liquid level of the slurry is in the reactor, the larger the effective area of the heat exchanger tube is.

In a commonly-performed start-up method for the reactor, the slurry is loaded into the reactor in an initial stage of the FT synthesis reaction in such a way that a liquid level thereof reaches the same level as that in a steady-state operation, in order to secure the larger effective area of the heat exchanger tube thereby increasing the CO conversion ratio rapidly.

PRIOR ART DOCUMENT

Patent Document

Patent Document 1: United States Patent Application, Publication No. 2005/0027020

SUMMARY OF THE INVENTION

Technical Problem

Since a liquid medium included in the slurry loaded into the reactor in the initial stage of the FT synthesis reaction does not meet the requirement of liquid hydrocarbon and therefore is not the desired product, manufacture of the product cannot be started until all the liquid medium included in the slurry loaded into the reactor at the initial stage of the FT synthesis reaction is replaced with liquid hydrocarbon synthesized by FT synthesis reaction.

In the above-mentioned conventional start-up method for a hydrocarbon synthesis reaction apparatus, the slurry is loaded into the reactor at the initial stage of the FT synthesis reaction so that a liquid level thereof reaches the same level as that in the steady-state operation. Therefore, it takes a long time to replace all the liquid medium included in the slurry loaded into the reactor at the initial stage of the FT synthesis reaction with liquid hydrocarbon synthesized by FT synthesis reaction, and feedstock supplied to the reactor is wasted since the feedstock does not become the desired products and is discarded during replacement of the liquid medium.

That is, the conventional start-up method for a hydrocarbon synthesis reaction apparatus requires a long time and is economically inefficient.

Under these circumstances, the inventors conceived of a process in which the slurry is loaded into the reactor at the initial stage of the FT synthesis reaction, wherein the amount thereof is less than that in the steady-state operation. In this case, however, since the liquid level of the slurry loaded into the reactor at the initial stage of the FT synthesis reaction is lower than that in the steady-state operation, the effective area of the heat exchanger tube for removing the heat from the slurry becomes smaller, and therefore it is not possible to cool the slurry efficiently. Thus, the catalyst is possibly thermally-deteriorated by a rapid increase in temperature of the slurry caused by an accelerated FT synthesis reaction, as described above.

The present invention has been developed in light of the above circumstances, and has an object of providing a start-up method of a hydrocarbon synthesis reaction apparatus which is capable of shortening the time taken in the start-up of the hydrocarbon synthesis reaction apparatus, reducing loss of the feedstock during the start-up of a hydrocarbon synthesis reaction apparatus so as to improve the economic performance of a plant, and preventing the slurry from the thermal deterioration in the slurry caused by rapid increase in the temperature of the slurry.

Solution to Problem

The present invention relates to a start-up method of a hydrocarbon synthesis reaction apparatus, wherein the reaction apparatus is provided with a reactor in which a hydrocarbon is synthesized by a Fischer-Tropsch synthesis reaction of a synthesis gas, whose main components are hydrogen and carbon monoxide, with a slurry including a suspension of catalyst particles, and a cooling device including a vertical heat exchanger tube in contact with the slurry used to remove heat generated by the hydrocarbon synthesis reaction. The method of the present invention includes: an initial slurry-loading step in which the slurry is loaded into the reactor at the initial stage of the Fischer-Tropsch synthesis reaction at a lower loading rate than that applied to the reactor in steady operation; and a CO conversion ratio-increasing step in which the liquid level of the slurry in the reactor is raised by adding to the slurry the hydrocarbons synthesized at the early stage of the Fischer-Tropsch synthesis reaction so that the CO conversion ratio is increased in proportion to a rise in the liquid level of the slurry in the reactor.

In the start-up of a hydrocarbon synthesis reaction apparatus, the slurry is loaded into the reactor at the initial stage of FT synthesis reaction, wherein the loading rate of the slurry loaded into the reactor is less than that of the slurry to be loaded into the reactor in the steady-state operation. Then, the slurry is heated arbitrarily by a heating device (a device in which heat-transfer medium passes through a heat exchanger tube or the like, for example) with supplying the synthesis gas including hydrogen gas and carbon monoxide gas as main components to the reactor. After the temperature of the slurry reaches a predetermined temperature, for example 150° C., a hydrocarbon is synthesized in a reactor by an FT synthesis reaction. The heat generated by synthesizing the hydrocarbon is removed by the heat exchanger tube in contact with the slurry. The liquid level of the slurry rises gradually in the reactor by liquid hydrocarbon in the hydrocarbon synthesized being added thereto.

Here, an effective area of the heat exchanger tube, in contact with the slurry, for removing the heat from the slurry gradually increases with the rise in the liquid level of the slurry since the heat exchanger tube are vertically installed. That is, the cooling capacity of the heat exchanger tube increases. Thus, the cooling capacity of the heat exchanger tube increases with the rise in the liquid level of the slurry.

The CO conversion ratio in the reactor is increased in proportion to the rise in the liquid level of the slurry; in other words, in consideration of cooling capacity of the heat exchanger tube. As a result, it is possible to prevent the temperature of the slurry from rapid increase to thereby prevent the catalyst from thermal deterioration.

As described above, in the start-up of a hydrocarbon synthesis reaction apparatus, the loading rate of the slurry loaded into the reactor at the initial stage of FT synthesis reaction is less than that in the steady-state operation. Thus, it is possible to shorten the time to replace the liquid medium included in the slurry loaded at the initial stage with liquid hydrocarbon synthesized by FT synthesis reaction, as much as reducing the loading rate of the slurry loaded at the initial stage. Further, feedstock supplied to the reactor is wasted since the feedstock does not become desired products and is discarded during replacement of the liquid medium included in the slurry loaded at the initial stage. However, since it is possible to shorten the time to finish replacement of the liquid medium included in the slurry loaded at the initial stage, it is possible to reduce loss of the feedstock in the start-up of a hydrocarbon synthesis reaction apparatus.

In the start-up method of the hydrocarbon synthesis reaction apparatus of the present invention, it may be such that the heat removal rate by the cooling device, in removing the heat generated by the hydrocarbon synthesis reaction from the slurry, to be calculated from an effective area of the heat exchanger tube throughout the CO conversion ratio-increasing step, and the CO conversion ratio to be increased by controlling the temperature of the slurry under the condition that a variation of the heat removal rate in response to a variation of the temperature of the slurry exceeds a variation of the heat generation rate of the hydrocarbon synthesis reaction in response to the variation of the temperature of the slurry.

The temperature of the slurry and the CO conversion ratio are in one-to-one correspondence when other conditions are the same. In particular, the temperature of the slurry is determined, the CO conversion ratio corresponding to the temperature is determined, and then a heat generation rate in the slurry by FT synthesis reaction corresponding to the CO conversion ratio is determined. Accordingly, the temperature of the slurry is determined, and then the heat generation rate in the slurry by FT synthesis reaction corresponding to the temperature is determined.

The temperature of the slurry is controlled in proportion to the rise in the liquid level of the slurry; that is, in consideration of cooling capacity of the heat exchanger tube in contact with the slurry. Therefore, it is possible to suppress a rapid increase in temperature caused by heat generated by FT synthesis reaction, and the CO conversion ratio can be increased.

Specifically, the temperature of the slurry is determined under the condition that the variation of the heat removal rate in response to the variation of the temperature of the slurry exceeds the variation of the heat generation rate of the hydrocarbon synthesis reaction in response to the variation of the temperature of the slurry. When the temperature of the slurry is set to a temperature determined as above, if the temperature of the slurry increases slightly for any reasons, since the variation of the heat removal rate in response to the variation of the temperature of the slurry exceeds the variation of the heat generation rate of the hydrocarbon synthesis reaction in response to the variation of the temperature of the slurry, the temperature of the slurry decreases. Thus, the temperature of the slurry is stable, and it is possible to prevent the rapid increase in the temperature of the slurry by synthesizing the hydrocarbon.

In the start-up method of the hydrocarbon synthesis reaction apparatus of the present invention, it may be such that the temperature of the coolant flowing through the heat exchanger tube to be varied to control the temperature of the slurry throughout the CO conversion ratio-increasing step.

Since the temperature of the coolant flowed through the heat exchanger tube is controlled, it is possible to control the temperature of the slurry in contact with the heat exchanger tube so as to be the predetermined temperature.

In the start-up method of the hydrocarbon synthesis reaction apparatus of the present invention, it may be such that the temperature of the slurry to be maintained in a range of 150° C. to 240° C., throughout the CO conversion ratio-increasing step.

The catalyst particles generally used for FT synthesis reaction, such as cobalt catalyst and the like, accelerate the FT synthesis reaction at more than 150° C., and are thermally-deteriorated at more than 240° C. Therefore, it is possible to accelerate the FT synthesis reaction efficiently, by maintaining the temperature of the slurry in the range of 150° C. to 240° C.

Advantageous Effects of the Invention

According to the present invention, it is possible to shorten the start-up time of a hydrocarbon synthesis reaction apparatus and to reduce loss of the feedstock during the start-up of a hydrocarbon synthesis reaction apparatus. Hence, it is possible to improve the economic performance of a plant and prevent thermal deterioration of the catalyst particles caused by an increase in the temperature of the slurry.

According to the present invention, the temperature of the slurry is controlled in proportion to the rise in the liquid level of the slurry; that is, in consideration of the cooling capacity of the heat exchanger tube. Therefore, it is possible to suppress the rapid increase in the temperature caused by heat generated in the slurry by the FT synthesis reaction, and the CO conversion ratio can increase.

According to the present invention, since the temperature of the coolant flowing through the heat exchanger tube is controlled, it is possible to control the temperature of the slurry in contact with the heat exchanger tube to be the predetermined temperature. Therefore, it is possible to suppress the rapid increase in the temperature of the slurry caused by heat generated in the slurry by the FT synthesis reaction, and the CO conversion ratio can be increased efficiently.

According to the present invention, it is possible to accelerate FT synthesis reaction efficiently, by maintaining the temperature of the slurry in the range of 150° C. to 240° C.

DETAILED DESCRIPTION OF THE INVENTION

Hereinafter, a description will be given of one embodiment of the hydrocarbon synthesis reaction system including the hydrocarbon synthesis reaction apparatus of the present invention with reference to the drawings.

(Liquid Fuel Synthesizing System)

Figure 1:
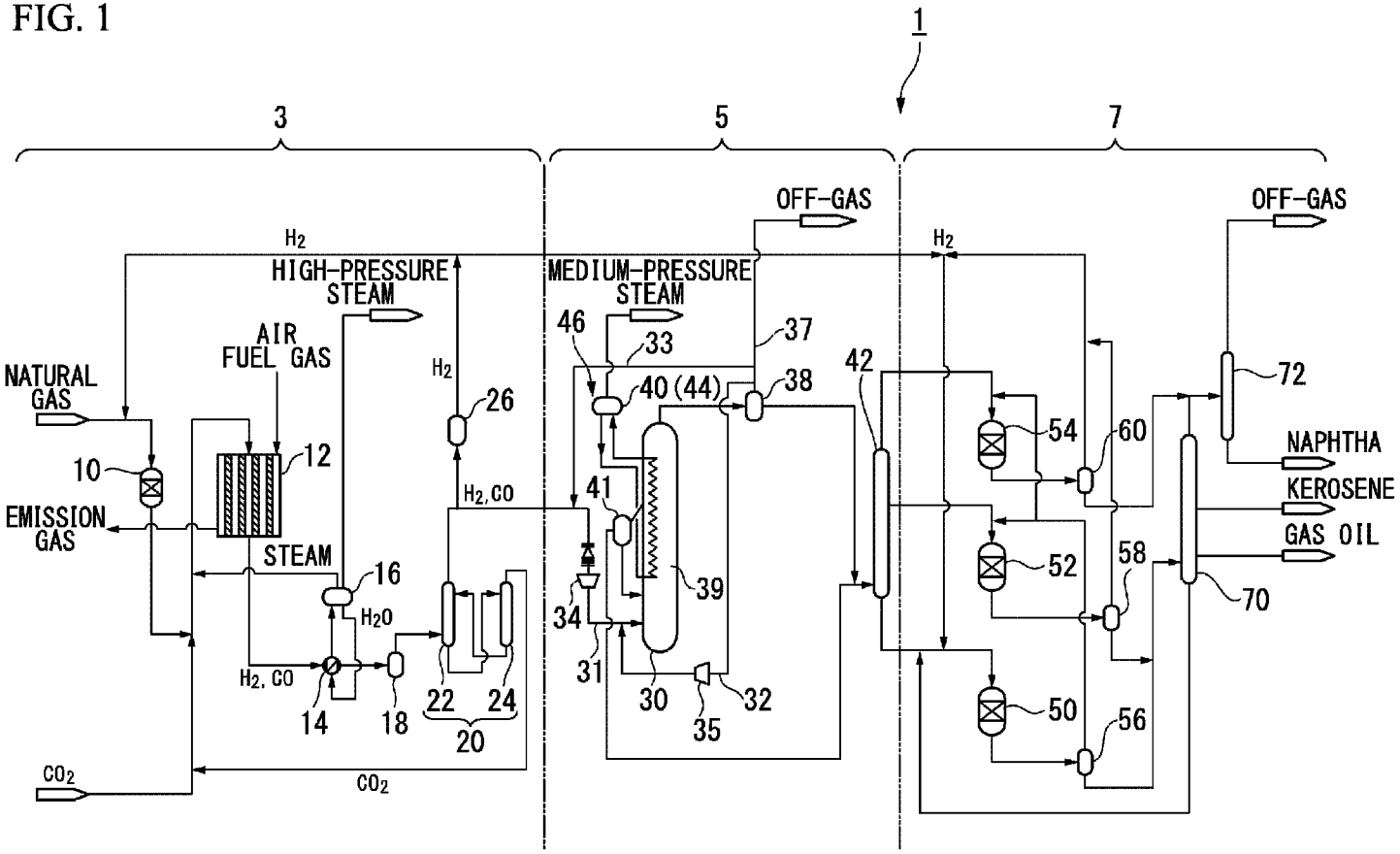
FIG. 1 is a schematic diagram illustrating the overall structure of a liquid fuel synthesis system according to an embodiment of the present invention, provided with a start-up method of a hydrocarbon synthesis reaction apparatus.

FIG. 1 is a systematic diagram showing the structure of a liquid fuel synthesizing system used for carrying out an embodiment of a start-up method for a hydrocarbon synthesis reaction apparatus of the present invention.

As illustrated in FIG. 1, the liquid fuel synthesizing system (hydrocarbon synthesis reaction system) 1 is a plant facility which carries out a GTL process that converts a hydrocarbon feedstock such as a natural gas into liquid fuels. This liquid fuel synthesizing system 1 includes a synthesis gas production unit 3, an FT synthesis unit (hydrocarbon synthesis reaction apparatus) 5, and an upgrading unit 7. The synthesis gas production unit 3 configured to reform a natural gas that functions as a hydrocarbon feedstock to produce a synthesis gas containing carbon monoxide gas and hydrogen gas. The FT synthesizing unit 5 configured to produce liquid hydrocarbon compounds from the produced synthesis gas via the FT synthesis reaction. The upgrading unit 7 is configured to hydrotreat the liquid hydrocarbon compounds synthesized by the FT synthesis reaction to produce liquid fuels and other products (such as naphtha, kerosene, gas oil, and wax). Structural elements of each of these units are described below.

First is a description of the synthesis gas production unit 3.

The synthesis gas production unit 3 is, for example, composed mainly of a desulfurization reactor 10, a reformer 12, a waste heat boiler 14, gas-liquid separators 16 and 18, a $CO_2$ removal unit 20, and a hydrogen separator 26. The desulfurization reactor 10 is composed of a hydrodesulfurizer and the like, and removes sulfur components from the natural gas that functions as the feedstock. The reformer 12 reforms the natural gas supplied from the desulfurization reactor 10 to produce a synthesis gas containing carbon monoxide gas (CO) and hydrogen gas ($H_2$) as main components. The waste heat boiler 14 recovers waste heat from the synthesis gas produced in the reformer 12 to generate a high-pressure steam. The gas-liquid separator 16 separates the water that has been heated by heat exchange with the synthesis gas in the waste heat boiler 14 into a gas (high-pressure steam) and a liquid. The gas-liquid separator 18 removes a condensed component from the synthesis gas that has been cooled in the waste heat boiler 14, and supplies a gas component to the $CO_2$ removal unit 20.

The $CO_2$ removal unit 20 has an absorption tower (second absorption tower) 22 and a regeneration tower 24. The absorption tower 22 uses an absorbent to absorb carbon dioxide gas contained in the synthesis gas supplied from the gas-liquid separator 18. The regeneration tower 24 strips the carbon dioxide gas absorbed by the absorbent, thereby regenerating the absorbent. The hydrogen separator 26 separates a portion of the hydrogen gas contained in the synthesis gas from which the carbon dioxide gas has already been separated by the $CO_2$ removal unit 20. In some cases, the above $CO_2$ removal unit 20 may not need to be provided.

In the reformer 12, for example, by utilizing steam and carbon dioxide gas reforming method represented by the chemical reaction formulas (1) and (2) shown below, the natural gas is reformed by carbon dioxide and steam, and a high-temperature synthesis gas is produced which includes carbon monoxide gas and hydrogen gas as main components. However, the reforming method employed in the reformer 12 is not limited to this steam and carbon dioxide gas reforming method. For example, a steam reforming method, a partial oxidation reforming method (PDX) using oxygen, an autothermal reforming method (ATR) that is a combination of a partial oxidation reforming method and a steam reforming method, a carbon dioxide gas reforming method, and the like, may also be used.

$$CH_4+H_2O \rightarrow CO+3H_2 \quad (1)$$

$$CH_4+CO_2 \rightarrow 2CO+2H_2 \quad (2)$$

The hydrogen separator 26 is provided on a branch line that branches off a main line which connects the $CO_2$ removal unit 20 or the gas-liquid separator 18 with a slurry bubble column reactor 30. This hydrogen separator 26 may be composed of for example, a hydrogen PSA (Pressure Swing Adsorption) apparatus, that performs adsorption and desorption of hydrogen by utilizing a pressure difference. This hydrogen PSA apparatus has adsorbents (such as a zeolitic adsorbent, activated carbon, alumina or silica gel) packed inside a plurality of adsorption towers (not shown in the drawings) that are arranged in parallel. By sequentially repeating each of the steps of hydrogen pressurization, adsorption, desorption (depressurization) and purging within each of these adsorption towers, the hydrogen PSA apparatus can continuously supply a high-purity hydrogen gas (of approximately 99.999% purity, for example) that has been separated from the synthesis gas.

The hydrogen gas separating method employed in the hydrogen separator 26 is not limited to the type of pressure swing adsorption method utilized by the above hydrogen PSA apparatus, and for example, a hydrogen storing alloy adsorption method, a membrane separation method, or a combination thereof may also be used.

The hydrogen storing alloy method is a technique for separating hydrogen gas using, for example, a hydrogen storing alloy (such as TiFe, $LaNi_5$, $TiFe_{(0.7\ to\ 0.9)}Mn_{(0.3\ to\ 0.1)}$, or $TiMn_{1.5}$) that exhibits hydrogen adsorption and strip properties upon cooling and heating respectively. In the hydrogen storing alloy method, for example, hydrogen adsorption by cooling the hydrogen storing alloy, and hydrogen strip by heating the hydrogen storing alloy may be repeated alternately within a plurality of adsorption towers containing the hydrogen storing alloy. In this manner, hydrogen gas contained in the synthesis gas can be separated and recovered.

The membrane separation method is a technique that uses a membrane composed of a polymer material such as an aromatic polyimide to separate hydrogen gas, which exhibits superior membrane permeability, from a mixed gas. Since the membrane separation method does not require a phase change of the separation target materials in order to achieve separation, less energy is required for the separation operation, meaning the running costs are low. Further, because the structure of a membrane separation device is simple and compact, the facility costs are low and the surface area required to install the facility is small. Moreover, there is no driving device in a separation membrane and the stable operating range is broad, which offers another advantage in that maintenance is comparatively easy.

Next is a description of the FT synthesis unit 5.

The FT synthesis unit 5 mainly includes, for example, the reactor 30, a gas-liquid separator 40, a separator 41, a gas-liquid separator 38, a first fractionator 42. The reactor 30 uses the FT synthesis reaction to synthesize liquid hydrocarbon compounds from the synthesis gas produced by the aforementioned synthesis gas production unit 3, that is, from carbon monoxide gas and hydrogen gas. The gas-liquid separator 40 separates water that has been heated by passage through a heat exchanger tube 39 disposed inside the reactor 30 into steam (middle-pressure steam) and a liquid. The separator 41 is connected to the middle section of the reactor 30, and separates the catalyst and the liquid hydrocarbon compounds. The gas-liquid separator 38 is connected to the top of the reactor 30 to cool an unreacted synthesis gas and gaseous hydrocarbon compounds, thereby separating the liquid hydrocarbon compounds and a gas which contains the unreacted synthesis gas. This gas contains unnecessary components such as methane and, therefore, a portion of the gas is discharged as an off gas from the off-gas discharge line 37 to the outside of the system. The first fractionator 42 fractionally distills the liquid hydrocarbon compounds that have been supplied from the reactor 30 via the separator 41 and the gas-liquid separator 38 into a series of fractions.

The reactor 30 is an example of a reactor that synthesizes liquid hydrocarbon compounds from a synthesis gas, and functions as an FT synthesis reaction vessel that synthesizes liquid hydrocarbon compounds from the synthesis gas by the FT synthesis reaction. The reactor 30 is formed, for example, from a bubble column slurry bed type reactor in which a slurry composed mainly of catalyst particles and an oil medium (liquid medium, liquid hydrocarbons) is contained inside a column type vessel. This reactor 30 synthesizes gaseous or liquid hydrocarbon compounds from the synthesis gas by the FT synthesis reaction. Specifically, in the reactor 30, a synthesis gas that represents the feedstock gas is supplied as gas bubbles from a sparger positioned in the bottom of the reactor 30, and these gas bubbles pass through the slurry, which has been formed by suspending catalyst particles in the oil medium. In this suspended state, the hydrogen gas and carbon monoxide gas contained in the synthesis gas react with each other to synthesize hydrocarbon compounds, as shown in the following chemical reaction formula (3).

$$2nH_2+nCO \rightarrow (-CH_2-)_n+nH_2O \tag{3}$$

Here, in the above-described reaction, a percentage of carbon monoxide gas which has been consumed inside the reactor with respect to the carbon monoxide gas (CO) supplied to the FT synthesis unit 5 is referred to as the "CO conversion rate" herein. This CO conversion rate is calculated as a percentage of a molar flow rate of carbon monoxide gas in the off-gas which flows into the FT synthesis unit 5 per unit time (synthesis gas-to-CO molar flow rate) and a molar flow rate of carbon monoxide gas in off-gas drawn out per unit time through the off-gas discharge line 37 from the FT synthesis unit 5 (off gas-to-CO molar flow rate). That is, the CO conversion rate is determined by the following formula (4).

$$\text{CO conversion rate} = \frac{(\text{synthesis gas-to-CO molar flow rate}) - (\text{off gas-to-CO molar flow rate})}{\text{synthesis gas-to-CO molar flow rate}} \times 100 \tag{4}$$

Because the FT synthesis reaction is an exothermic reaction, the reactor 30 is a heat-exchange-type reactor having the heat exchanger tube 39 disposed inside the reactor 30. The reactor 30 is supplied, for example, with water (BFW: Boiler Feed Water) as a coolant so that the reaction heat of the above-described FT synthesis reaction can be recovered in the form of a middle-pressure steam by heat exchange between the slurry and the water.

In addition to the reactor 30, the gas-liquid separator 38 and the off-gas discharge line 37, the FT synthesis unit 5 is also provided with a synthesis gas supply line 31, a first recycle line 32 and a second recycle line 33. In the synthesis gas supply line 31, a synthesis gas containing a carbon monoxide gas and a hydrogen gas as main components is sent by the synthesis gas production unit 3 (synthesis gas sending device) and the synthesis gas is compressed and supplied by the first compressor 34. In the first recycle line 32, the unreacted synthesis gas after separation by the gas-liquid separator 38 is compressed and recycled into the reactor 30 by the second compressor 35. The second recycle line 33 is configured to recycle into the inlet side of the first compressor 34 a residual unreacted synthesis gas to be introduced into the first recycle line 32, a part of the unreacted synthesis gas after separation by the gas-liquid separator 38, at the time of start-up operation when the synthesis gas to be introduced from the synthesis gas production unit 3 into the reactor 30 is gradually increased in the introduction rate from a processing flow rate lower than a processing flow rate of the synthesis gas processed during a normal operation (for example, 70% on the assumption that the processing flow rate during the normal operation is given as 100%) to a processing flow rate of the synthesis gas during the normal operation (100% of the flow rate during the normal operation).

In this case, one of a plurality of lines of an inert gas that flows within a system at the time of starting up the reactor 30 also functions as the second recycle line 33.

Next is a description of the upgrading unit 7. The upgrading unit 7 includes, for example, a wax fraction-hydrocracking reactor 50, a middle distillate-hydrotreating reactor 52, a naphtha fraction-hydrotreating reactor 54, gas-liquid separators 56, 58 and 60, a second fractionator 70, and a naphtha stabilizer 72. The wax fraction-hydrocracking reactor 50 is connected to the bottom of the first fractionator 42.

The middle distillate-hydrotreating reactor 52 is connected to a middle section of the first fractionator 42. The naphtha fraction-hydrotreating reactor 54 is connected to the top of the first fractionator 42. The gas-liquid separators 56, 58 and 60 are provided so as to correspond to the hydrogenation reactors 50, 52 and 54 respectively. The second fractionator 70 fractionally distills the liquid hydrocarbon compounds supplied from the gas-liquid separators 56 and 58. The naphtha stabilizer 72 rectifies the liquid hydrocarbon compounds within the naphtha fraction supplied from the gas-liquid separator 60 and which is fractionally distilled in the second fractionator 70. As a result, the naphtha stabilizer 72 discharges butane and components lighter than butane as an off-gas, and recovers components having a carbon number of five or more as a naphtha product.

Next is a description of a process for synthesizing liquid fuels from a natural gas during a normal operation (GTL process) using the liquid fuel synthesizing system 1 having the structure described above.

A natural gas (the main component of which is $CH_4$) is supplied as a hydrocarbon feedstock to the liquid fuel synthesizing system 1 from an external natural gas supply source (not shown in the drawings), such as a natural gas field or a natural gas plant. The above synthesis gas production unit 3 reforms the natural gas to produce a synthesis gas (a mixed gas containing carbon monoxide gas and hydrogen gas as main components).

Specifically, first, the natural gas described above is introduced to the desulfurization reactor 10 together with the hydrogen gas separated by the hydrogen separator 26. In the desulfurization reactor 10, sulfur components included in the natural gas are converted into hydrogen sulfide by the introduced hydrogen gas and the hydrodesulfurization catalyst. Further, in the desulfurization reactor 10, the produced hydrogen sulfide is absorbed and removed by a desulfurizing agent such as ZnO. By desulfurizing the natural gas in advance in this manner, reduction in the activity of the catalysts used in the reformer 12, the reactor 30 and so on, due to sulfur can be prevented.

The natural gas (which may also include carbon dioxide) that has been desulfurized in this manner is supplied to the reformer 12 after mixing with carbon dioxide gas ($CO_2$) supplied from a carbon dioxide supply source (not shown in the drawings) and the steam generated in the waste heat boiler 14. In the reformer 12, for example, the natural gas is reformed by the carbon dioxide gas and the steam via the aforementioned steam-carbon dioxide-reforming process, thereby producing a high-temperature synthesis gas including carbon monoxide gas and hydrogen gas as main components. At this time, for example, a fuel gas and air for a burner installed in the reformer 12 are supplied to the reformer 12, and the combustion heat from the fuel gas in the burner is used to provide the necessary reaction heat for the above steam-carbon dioxide gas-reforming reaction, which is an endothermic reaction.

The high-temperature synthesis gas (for example, 900° C., 2.0 MPaG) produced in the reformer 12 in this manner is supplied to the waste heat boiler 14, and is cooled (for example, to 400° C.) by heat exchange with the water flowing through the waste heat boiler 14, thereby recovering the waste heat from the synthesis gas.

At this time, the water heated by the synthesis gas in the waste heat boiler 14 is supplied to the gas-liquid separator 16. In the gas-liquid separator 16, the water that has been heated by the synthesis gas is separated into a high-pressure steam (for example, 3.4 to 10.0 MPaG) and water. The separated high-pressure steam is supplied to the reformer 12 or other external devices, whereas the separated water is returned to the waste heat boiler 14.

The synthesis gas that has been cooled within the waste heat boiler 14 is supplied to either the absorption tower 22 of the $CO_2$ removal unit 20 or the reactor 30, after a condensed liquid fraction has been separated and removed from the synthesis gas in the gas-liquid separator 18. In the absorption tower 22, carbon dioxide gas contained in the synthesis gas is absorbed by an absorbent stored in the absorption tower 22, thereby removing the carbon dioxide gas from the synthesis gas. The absorbent that has absorbed the carbon dioxide gas within the absorption tower 22 is discharged from the absorption tower 22 and introduced into the regeneration tower 24. This absorbent that has been introduced into the regeneration tower 24 is then heated, for example, with steam, and subjected to a stripping treatment to strip the carbon dioxide gas. The striped carbon dioxide gas is discharged from the regeneration tower 24 and introduced into the reformer 12, where it can be reused for the above reforming reaction.

The synthesis gas produced in the synthesis gas production unit 3 in this manner is supplied to the reactor 30 of the above FT synthesis unit 5. At this time, the composition ratio of the synthesis gas supplied to the reactor 30 is adjusted to a composition ratio suitable for the FT synthesis reaction (for example, $H_2$:CO=2:1 (molar ratio)). In addition, the synthesis gas supplied to the reactor 30 is pressurized to a pressure suitable for the FT synthesis reaction (for example, approximately 3.6 MPaG) by the first compressor 34 provided in the line connecting the $CO_2$ removal unit 20 with the reactor 30.

Furthermore, a portion of the synthesis gas that has undergone separation of the carbon dioxide gas by the above $CO_2$ removal unit 20 is also supplied to the hydrogen separator 26. In the hydrogen separator 26, the hydrogen gas contained in the synthesis gas is separated by adsorption and desorption utilizing a pressure difference (hydrogen PSA) as described above. The separated hydrogen gas is supplied continuously from a gas holder or the like (not shown in the drawings) via a compressor (not shown in the drawings) to the various hydrogen-utilizing reactors (for example, the desulfurization reactor 10, the wax fraction-hydrocracking reactor 50, the middle distillate-hydrotreating reactor 52, the naphtha fraction-hydrotreating reactor 54 and so on) within the liquid fuel synthesizing system 1 that performs predetermined reactions using hydrogen.

The FT synthesis unit 5 synthesizes liquid hydrocarbon compounds by the FT synthesis reaction from the synthesis gas produced in the above synthesis gas production unit 3.

Specifically, the synthesis gas that has undergone separation of the carbon dioxide gas by the above $CO_2$ removal unit 20 is introduced into the reactor 30, and flows through the slurry including the catalyst contained in the reactor 30. During this time within the reactor 30, the carbon monoxide and hydrogen gas contained in the synthesis gas react with each other by the aforementioned FT synthesis reaction, and hydrocarbon compounds are produced. Moreover, during this FT synthesis reaction, the reaction heat of the FT synthesis reaction is recovered by water flowing through the heat exchanger tube 39 of the reactor 30, and the water that has been heated by this reaction heat is vaporized into steam. This steam is supplied to the gas-liquid separator 40 and separated into condensed water and a gas fraction. The water is returned to the heat exchanger tube 39, while the gas fraction is supplied to an external device as a middle-pressure steam (for example, 1.0 to 2.5 MPaG).

The liquid hydrocarbon compounds synthesized in the reactor 30 in this manner are discharged from the middle section of the reactor 30 as a slurry that includes catalyst particles, and this slurry is introduced into the separator 41. In the separator 41, the introduced slurry is separated into the catalyst (the solid fraction) and a liquid fraction containing the liquid hydrocarbon compounds. A portion of the separated catalyst is returned to the reactor 30, whereas the liquid fraction is introduced into the first fractionator 42. Gaseous by-products, including unreacted synthesis gas from the FT synthesis reaction and gaseous hydrocarbon compounds produced in the FT synthesis reaction, are discharged from the top of the reactor 30. The gaseous by-products discharged from the reactor 30 are introduced into the gas-liquid separator 38. In the gas-liquid separator 38, the introduced gaseous by-products are cooled and separated into condensed liquid hydrocarbon compounds and a gas fraction. The separated liquid hydrocarbon compounds are discharged from the gas-liquid separator 38 and introduced into the first fractionator 42.

The separated gas fraction is discharged from the gas-liquid separator 38, with a portion of the gas fraction being reintroduced into the reactor 30. In the reactor 30, the unreacted synthesis gases (CO and $H_2$) contained in the reintroduced gas fraction are reused for the FT synthesis reaction. Further, a portion of the gas fraction which has been discharged from the gas-liquid separator 38 is discharged from the off-gas discharge line 37 outside the system as an off-gas and used as a fuel, or fuels equivalent to LPG (Liquefied Petroleum Gas) may be recovered from this gas fraction.

In the first fractionator 42, the liquid hydrocarbon compounds (with various carbon numbers) supplied from the reactor 30 via the separator 41 and the gas-liquid separator 38 in the manner described above are fractionally distilled into a naphtha fraction (with a boiling point that is lower than approximately 150° C.), a middle distillate (with a boiling point of approximately 150 to 360° C.) and a wax fraction (with a boiling point that exceeds approximately 360° C.). The liquid hydrocarbon compounds of the wax fraction (mainly $C_{22}$ or higher) discharged from the bottom of the first fractionator 42 are introduced into the wax fraction-hydrocracking reactor 50. The liquid hydrocarbon compounds of the middle distillate equivalent to kerosene and gas oil (mainly $C_{11}$ to $C_{21}$) discharged from the middle section of the first fractionator 42 are introduced into the middle distillate-hydrotreating reactor 52. The liquid hydrocarbon compounds of the naphtha fraction (mainly $C_5$ to $C_{10}$) discharged from the top of the first fractionator 42 are introduced into the naphtha fraction-hydrotreating reactor 54.

The wax fraction-hydrocracking reactor 50 hydrocracks the liquid hydrocarbon compounds of the high-carbon number wax fraction (hydrocarbons of approximately $C_{22}$ or higher) discharged from the bottom of the first fractionator 42 by using the hydrogen gas supplied from the above-described hydrogen separator 26 to reduce the carbon number to 21 or less. In this hydrocracking reaction, C—C bonds of hydrocarbon compounds with a large carbon number are cleaved. This process converts the hydrocarbon compounds with a large carbon number to hydrocarbon compounds with a small carbon number. Further, in the wax fraction-hydrocracking reactor 50, the reaction for hydroisomerizing linear saturated hydrocarbon compounds (normal paraffins) to produce branched saturated hydrocarbon compounds (isoparaffins) proceeds in parallel with the hydrocracking reaction. This improves the low-temperature fluidity of the wax fraction hydrocracked product, which is a required property for a fuel oil base stock. Moreover, in the wax fraction-hydrocracking reactor 50, a hydrodeoxygenation reaction of oxygen-containing compounds such as alcohols, and a hydrogenation reaction of olefins, both of which may be contained in the wax fraction that functions as the feedstock, also proceed during the hydrocracking process. The products including the liquid hydrocarbon compounds hydrocracked and discharged from the wax fraction-hydrocracking reactor 50 are introduced into the gas-liquid separator 56, and separated into a gas and a liquid. The separated liquid hydrocarbon compounds are introduced into the second fractionator 70, and the separated gas fraction (which includes hydrogen gas) is introduced into the middle distillate-hydrotreating reactor 52 and the naphtha fraction-hydrotreating reactor 54.

In the middle distillate-hydrotreating reactor 52, the liquid hydrocarbon compounds of the middle distillate equivalent to kerosene and gas oil, which have a mid-range carbon number (of approximately $C_{11}$ to $C_{21}$) and have been discharged from the middle section of the first fractionator 42, are hydrotreated. In the middle distillate-hydrotreating reactor 52, hydrogen gas supplied from the hydrogen separator 26 via the wax fraction-hydrocracking reactor 50 is used for the hydrotreating. In this hydrotreating reaction, olefins contained in the above liquid hydrocarbon compounds are hydrogenated to produce saturated hydrocarbon compounds, and oxygen-containing compounds such as alcohols contained in the liquid hydrocarbon compounds are hydrodeoxygenated and converted into saturated hydrocarbon compounds and water. Moreover, in this hydrotreating reaction, a hydroisomerization reaction that isomerizes linear saturated hydrocarbon compounds (normal paraffins) and converts them into branched saturated hydrocarbon compounds (isoparaffins) also proceeds, thereby improving the low-temperature fluidity of the product oil, which is a required property for a fuel oil. The product including the hydrotreated liquid hydrocarbon compounds is separated into a gas and a liquid in the gas-liquid separator 58.

The separated liquid hydrocarbon compounds are introduced into the second fractionator 70, and the separated gas fraction (which includes hydrogen gas) is reused for the above hydrogenation reaction.

In the naphtha fraction-hydrotreating reactor 54, the liquid hydrocarbon compounds of the naphtha fraction, which have a low carbon number (approximately $C_{10}$ or less) and have been discharged from the top of the first fractionator 42, are hydrotreated. In the naphtha fraction-hydrotreating reactor 54, hydrogen gas supplied from the hydrogen separator 26 via the wax fraction-hydrocracking reactor 50 is used for the hydrotreating. In the naphtha fraction-hydrotreating reaction, the hydrogenation of olefins and hydrodeoxygenation of oxygen-containing compounds such as alcohols mainly proceed. The product including hydrotreated liquid hydrocarbon compounds is separated into a gas and a liquid in the gas-liquid separator 60. The separated liquid hydrocarbon compounds are introduced into the naphtha stabilizer 72, and the separated gas fraction (which includes hydrogen gas) is reused for the above hydrogenation reaction.

In the second fractionator 70, the liquid hydrocarbon compounds supplied from the wax fraction-hydrocracking reactor 50 and the middle distillate-hydrotreating reactor 52 in the manner described above are fractionally distilled into hydrocarbon compounds with a carbon number of $C_{10}$ or less (with boiling points lower than approximately 150° C.), a kerosene fraction (with a boiling point of approximately 150 to 250° C.), a gas oil fraction (with a boiling point of approximately 250 to 360° C.) and an uncracked wax fraction (with a boiling point exceeding approximately 360° C.) from the wax fraction-hydrocracking reactor 50. The uncracked wax fraction is obtained from the bottom of the second fractionator 70, and this is recycled to a position upstream of the wax fraction-hydrocracking reactor 50. Kerosene and gas oil are discharged from the middle section of the second fractionator 70. Meanwhile, hydrocarbon compounds of $C_{10}$ or less are discharged from the top of the second fractionator 70 and introduced into the naphtha stabilizer 72.

In the naphtha stabilizer 72, the hydrocarbon compounds of $C_{10}$ or less, which have been supplied from the naphtha fraction-hydrotreating reactor 54 and fractionally distilled in the second fractionator 70, are distilled, and naphtha ($C_5$ to $C_{10}$) is obtained as a product. Accordingly, high-purity naphtha is discharged from the bottom of the naphtha stabilizer 72. Meanwhile, an off-gas including mainly hydrocarbon compounds with a predetermined carbon number or less ($C_4$ or less), which is not a targeted product, is discharged from the top of the naphtha stabilizer 72. This off-gas is used as a fuel gas, or alternatively, a fuel equivalent to LPG may be recovered from the off-gas.

Next, a detailed explanation will be given of the start-up method of the FT synthesis unit 5 and of a structure of an apparatus used to carry out the start-up method.

Figure 2:
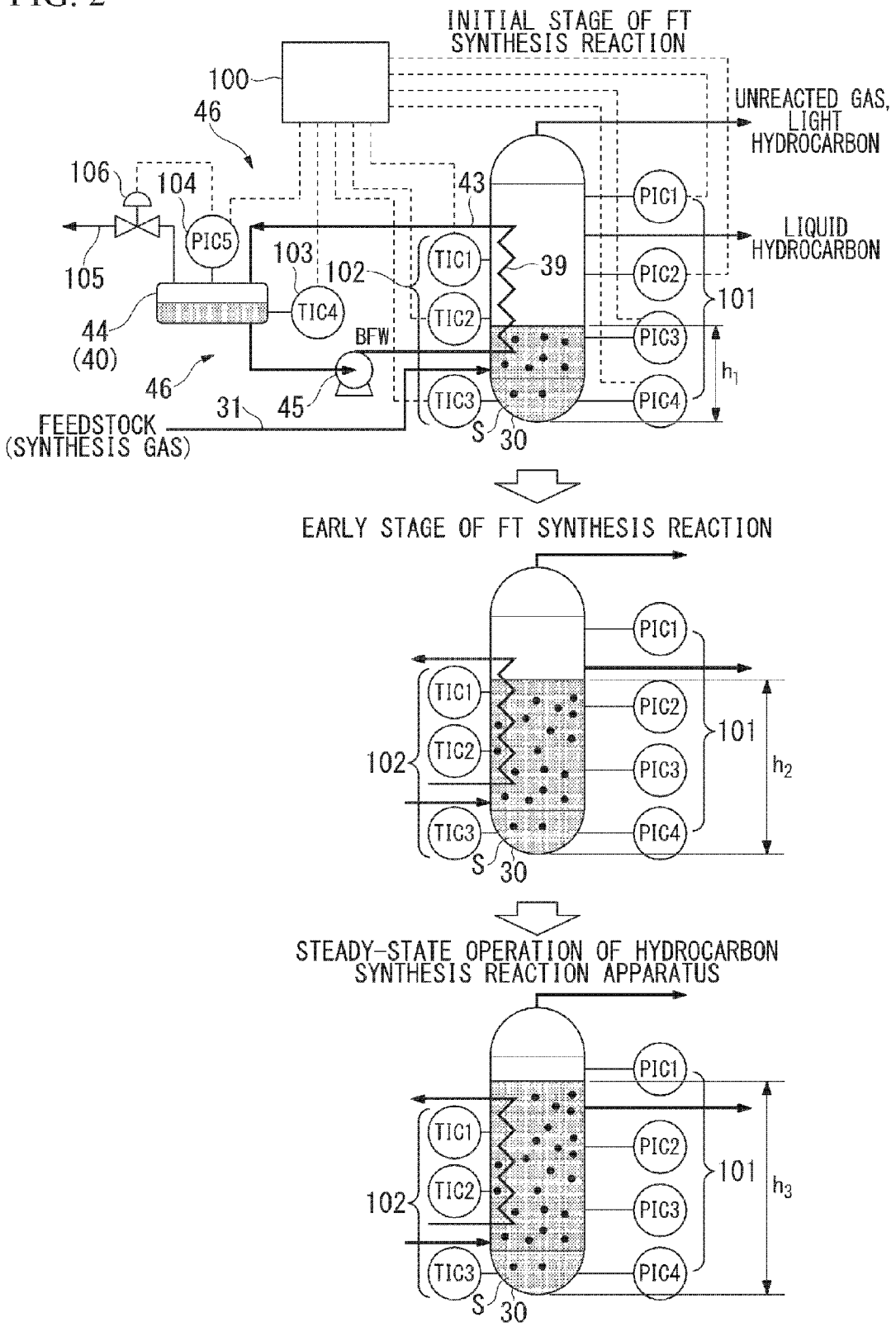
FIG. 2 is a schematic diagram illustrating the structure of the major component of the hydrocarbon synthesis reaction apparatus shown in FIG. 1.

First, the structure of the apparatus used to carry out the start-up method is described in reference to FIG. 2. FIG. 2 is a schematic diagram illustrating the structure in the major component of the FT synthesis unit (hydrocarbon synthesis reaction apparatus) 5 shown in FIG. 1.

The heat exchanger tube 39 vertically installed in the slurry bubble column reactor 30 is connected with a coolant circulating line 43 which is installed outside of the reactor 30. The coolant circulating line 43 is connected with a steam drum 44 which also functions as the gas-liquid separator 40, and a BFW pump 45 which circulates water (heated water) or steam as coolant through the coolant circulating line 43.

A cooling device 46 which is used to remove heat generated by synthesizing the hydrocarbon is configured as below. In the cooling device 46, the heated water in the steam drum 44 is circulated through the heat exchanger tube 39, the coolant circulating line 43, the steam drum 44, and the BFW pump 45, whereby the heated water flows in the heat exchanger tube 39 and is thermally contacted with the slurry S via the heat exchanger tube 39. In addition, water is supplied to the steam drum 44 via a supply line not shown in the drawings.

The reactor 30 has a control device 100. The control device 100 is connected with a liquid level sensor 101 which measures the liquid level of the slurry S in the reactor 30, a temperature sensor 102 which measures the temperature of the slurry S in the reactor 30, a temperature sensor 103 which detects the temperature of the coolant in the steam drum 44, and a pressure sensor 104 which determines the pressure in the steam drum 44. The liquid level sensor 101 is used to measure the liquid level of the slurry S based on the difference between the value detected by a pressure sensor PIC1 which is positioned on the uppermost part of the reactor 30 and values detected by pressure sensors PIC2, PIC3, and PIC4 which are arranged at different heights in the reactor 30. The temperature sensor 102 is used to determine the average temperature of the slurry S in the reactor 30 and the distribution of temperature in the height direction of the reactor 30 by using a plurality of temperature sensors TIC1, TIC2 and TIC3 which are arranged at different heights in the reactor 30.

The pressure sensor 104 is electrically connected with a solenoid valve 106 installed on a steam line 105 extending from the steam drum 44. The solenoid valve 106 is controlled based on a signal detected by the pressure sensor 104 so as to open or close the steam line 105 or to adjust the opening position of the solenoid valve 106.

The liquid level of the slurry S rises by hydrocarbon synthesized at the early stage of the operation of the reactor 30 being added to the slurry S, then the CO conversion ratio is controlled by the control device 100 to be increased in proportion to the rise in the liquid level of the slurry S. Specifically, the temperature of the slurry S is controlled in accordance with the rise in the liquid level of the slurry S in the reactor 30. It is described later in detail how to control the temperature of the slurry S.

Next, the start-up method of the FT synthesis unit 5 in which the above-mentioned structure is used is described.

1) As shown in FIG. 2, liquid medium in a predetermined amount is loaded into the reactor 30 before activating the FT synthesis unit 5. The predetermined amount of the liquid medium is the amount in which the liquid level $h_1$ of the slurry S having solid catalyst particles suspended in the liquid medium in the reactor 30 is lower than the liquid level $h_3$ of the slurry S in a steady operation of the FT synthesis unit 5. Specifically, the predetermined amount of the liquid medium is an amount corresponding to 40 to 50% of the liquid level of the slurry S in the reactor 30 in the steady-state operation of the FT synthesis unit 5, though varying depending on the type of the catalyst particles.

2) The liquid level $h_1$ of the slurry S having solid catalyst particles suspended in the liquid medium in the reactor 30 is obtained by using the liquid level sensor 101 connected with the control device 100. Specifically, the liquid level $h_1$ is obtained based on the difference between a value detected by the pressure sensor PIC1 which is positioned inside the reactor 30 so as to be higher than the other pressure sensors arranged in the reactor 30 and values detected by the pressure sensors PIC2, PIC3, and PIC4.

3) An area of the heat exchanger tube 39 in contact with the slurry S, that is, an effective area $A_1$ of the heat exchanger tube 39 for removing the heat from the slurry 5, is calculated based on the liquid level $h_1$ of the slurry S with arithmetic expressions or map, wherein one or more of the arithmetic expression and map is previously input to the control device 100.

4) The CO conversion ratio, which corresponds to the effective area $A_1$ and in which it is so stable that rapid exothermal reaction does not occur, is calculated. This CO conversion ratio is identified with a target CO conversion ratio $\eta_1$ corresponding to the liquid level $h_1$ of the slurry S at this point.

5) The relationship between the CO conversion ratio and the reaction temperature is unambiguously derivable from the reaction pressure, characteristics and the amount of the catalyst, and characteristics and amount of the synthesis gas supplied to the reactor 30. The target reaction temperature $T_1$ (that is the temperature of the slurry S) can be obtained by obtaining the target CO conversion ratio.

6) In order to adjust the temperature of the slurry S (temperature to be detected by the temperature sensor TIC1, TIC2 or TIC3 depending on the liquid level of the slurry S) to the target reaction temperature $T_1$, the temperature $t_1$ of the coolant (BFW) in the steam drum 44 is determined by the control device 100. The coolant at the temperature $t_1$ is supplied to the heat exchanger tube 39 by circulating the coolant through the coolant circulating line 43, while adjusting the temperature $t_1$ of the coolant (BFW) in the steam drum 44 by controlling the pressure P1 in the steam drum 44.

7) The synthesis gas as feedstock is introduced to the reactor 30 from the synthesis gas production unit 3, and then contacted with the slurry S in the reactor 30. At this time, the flow rate of the synthesis gas is 70% of that in the steady-state operation.

In parallel, the coolant (BFW) is supplied to the heat exchanger tube 39 from the steam drum 44 via the BFW pump 45, and the slurry S is heated by the coolant (BFW) via the heat exchanger tube 39 to 150° C. at which Fischer-Tropsch synthesis reaction occurs.

Note that the slurry S is heated via the heat exchanger tube 39 only in beginning of the start-up of the FT synthesis unit 5. Once the FT synthesis reaction occurs, the pressure in the steam drum 44 is controlled so as to remove heat from the slurry S via the heat exchanger tube 39 since the FT synthesis reaction is an exothermal reaction.

The liquid hydrocarbon synthesized by the FT synthesis reaction is added to the reactor 30 until the liquid level of the slurry S reaches the predetermined level. The gaseous hydrocarbon (light hydrocarbon gas) synthesized by the FT synthesis reaction and unreacted synthesis gas are discharged from the top of the reactor 30.

8) The liquid level of the slurry S rises by the liquid hydrocarbon synthesized by the FT synthesis reaction being added to the reactor 30 (the liquid level $h_2$ shown in FIG. 2). At this time, the above-mentioned processes 3) to 6) are repeated; thereby determining the target CO conversion ratio $\eta_2$, the target reaction temperature $T_2$, the temperature $t_2$ of the coolant in the steam drum 44, and the pressure P2 in the steam drum 44 using the control device 100. The pressure P2 in the steam drum 44 is controlled so as to be the determined pressure, thereby increasing the CO conversion ratio to $\eta_2$.

9) The above process 8) is repeated. After the liquid level of the slurry S and the CO conversion ratio reach those in the steady-state operation, then the flow rate of the synthesis gas as feedstock is set to a predetermined flow rate, resulting in steady operation.

Figure 3:
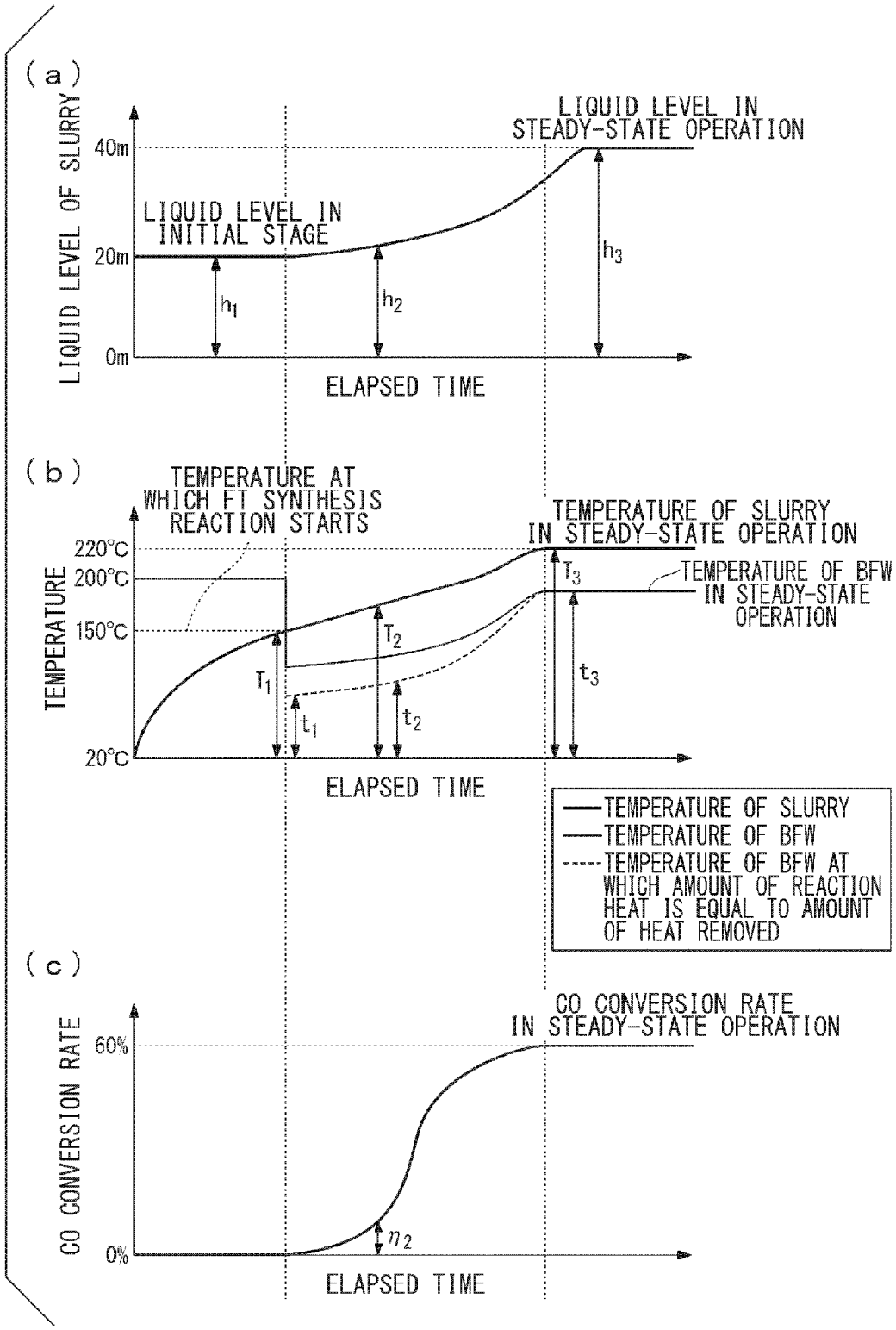
FIG. 3 shows charts of the conditions inside a slurry bubble column reactor during the start-up method for the embodiment of the present invention in the hydrocarbon synthesis reaction apparatus shown in FIG. 1: wherein (a) is a chart showing the variation of a liquid level of slurry; (b) is a chart showing the variation of temperature of the slurry and coolant (BFW); and (c) is a chart showing the variation of CO conversion ratio.

Next, the conditions inside the slurry bubble column reactor 30 during the start-up method of the FT synthesis unit 5 are described in reference to FIG. 3.

FIG. 3 is charts showing the conditions inside the reactor 30 during the start-up method of the embodiment of the present invention: wherein (a) is a chart showing the variation of the liquid level of slurry S; (b) is a chart showing the variation of temperature of the slurry S and the coolant (BFW); and (c) is a chart showing the variation of CO conversion ratio.

As described above, the liquid level of the slurry S in the initial stage of FT synthesis reaction is the liquid level $h_1$ which is lower than that of the slurry in the steady-state operation of the FT synthesis unit 5.

Steam (BFW) is supplied to the heat exchanger tube 39 from the steam drum 44, and the slurry S is heated via the heat exchanger tube 39 to 150° C. After the temperature of the slurry S reaches 150° C., the FT synthesis reaction starts.

After the FT synthesis reaction starts, the temperature of the coolant in the steam drum 44 is set at a temperature which is higher than that of the coolant at which a heat removal rate which is a rate of heat removed from the slurry S via the heat exchanger tube 39 is equal to the heat generation rate of the hydrocarbon synthesis reaction which is the rate of the heat generated by synthesizing the hydrocarbon. In this manner, the temperature of the slurry S rises by the heat generated by synthesizing the hydrocarbon.

While the liquid level of the slurry S is low, the FT synthesis unit 5 is operated at a relatively low value of the CO conversion ratio so as not to raise the temperature of the slurry rapidly.

The liquid level of the slurry S rises by the liquid hydrocarbon synthesized in the FT synthesis reaction being added to the reactor 30, and then the temperature of the slurry S increases accordingly.

After the temperature of the slurry S reaches 220° C., which is the temperature in the steady-state operation of the FT synthesis unit 5, the temperature of the coolant in the steam drum 44 is controlled so as to maintain the constant temperature of the slurry S, thereby maintaining the heat removal rate from the slurry S via the heat exchanger tube 39 at the same level as the heat generation rate of the hydrocarbon synthesis reaction.

After the liquid level of the slurry S reaches the liquid level thereof in the steady-state operation, the liquid hydrocarbon synthesized by the FT synthesis reaction is discharged to the outside of the reactor 30, thereby maintaining the constant liquid level of the slurry S.

Figure 5:
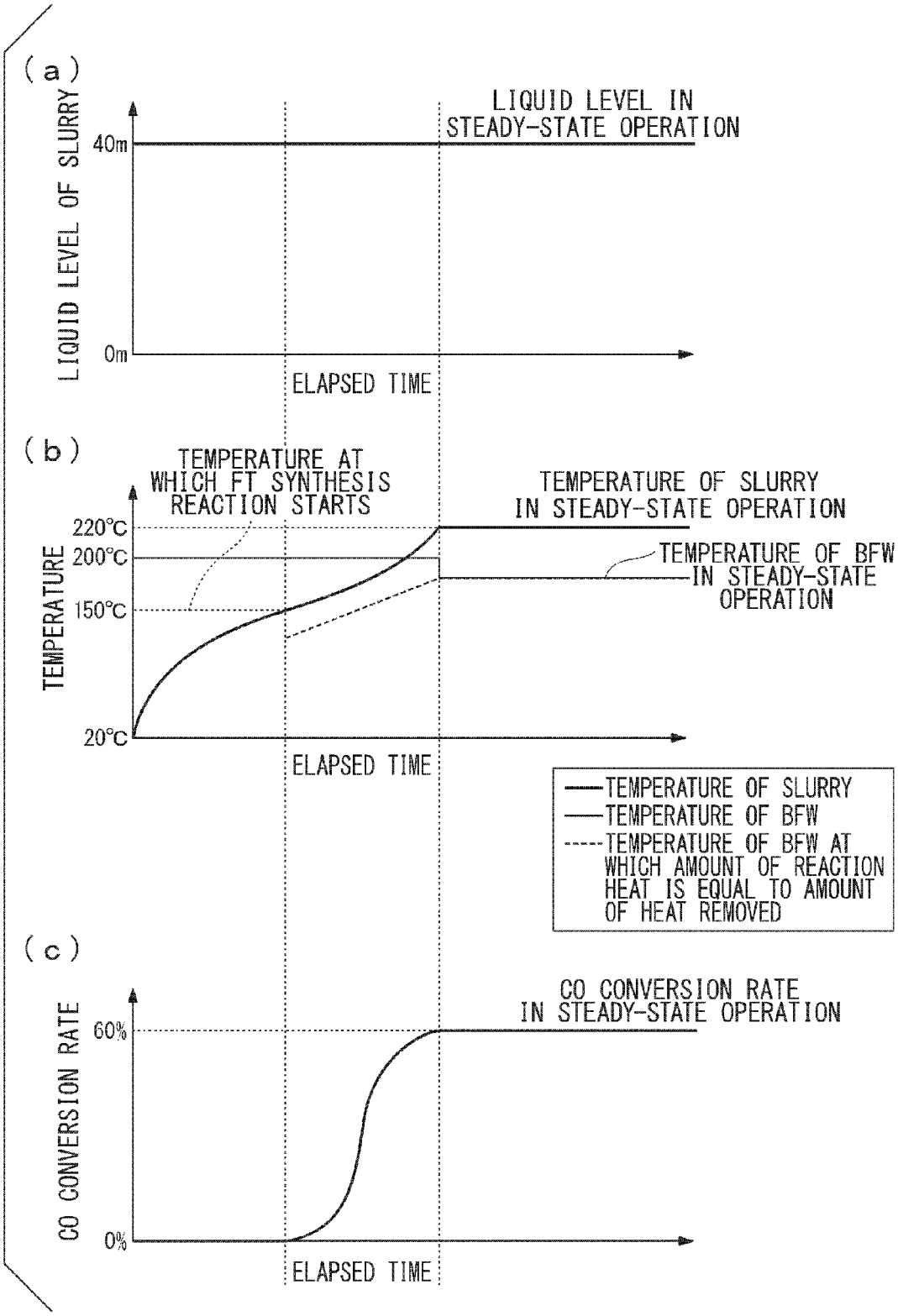
FIG. 5 shows charts of the conditions inside a slurry bubble column reactor when carrying out a conventional start-up method for a hydrocarbon synthesis reaction apparatus: wherein (a) is a chart showing the variation of a liquid level of slurry; (b) is a chart showing the variation of temperature of the slurry and coolant (BFW); and (c) is a chart showing the variation of CO conversion ratio.

For comparison, the conditions inside the slurry bubble column reactor during the conventional start-up method of the FT synthesis unit are described in reference to FIG. 5.

FIG. 5 shows charts of the conditions inside the reactor in the case of carrying out the conventional start-up method for a hydrocarbon synthesis reaction apparatus: wherein (a) is a chart showing the variation of the liquid level of slurry S; (b) is a chart showing the variation of temperature of the slurry S and the coolant (BFW); and (c) is a chart showing the variation of CO conversion ratio.

The liquid level of the slurry in the initial stage of FT synthesis reaction is the same level as that in the steady-state operation of the FT synthesis unit.

Steam is supplied to the heat exchanger tube from the steam drum, and the slurry is heated to 150° C. The FT synthesis reaction starts after the temperature of the slurry reaches 150° C.

During the FT synthesis reaction, the temperature of the slurry rises further by the heat generated by the FT synthesis reaction, and the CO conversion ratio depending on the temperature of the slurry increases. The heat generation rate of the hydrocarbon synthesis reaction at this time exceeds the heat removal rate from the slurry via the heat exchanger tube.

After the temperature of the slurry S reaches 220° C., which is the temperature in the steady-state operation, the temperature of the coolant in the steam drum is decreased so as to maintain the temperature of the slurry at a constant level, thereby maintaining the heat removal rate from the slurry via the heat exchanger tube at the same level as the heat generation rate of the hydrocarbon synthesis reaction.

The liquid hydrocarbon synthesized by the FT synthesis reaction is discharged to the outside of the reactor 30, thereby maintaining the constant liquid level of the slurry.

After the liquid level of the slurry S reaches the liquid level thereof in the steady-state operation, the liquid hydrocarbon synthesized by the Fischer-Tropsch synthesis reaction is discharged to outside of the reactor, thereby maintaining the constant liquid level of the slurry.

Figure 4:
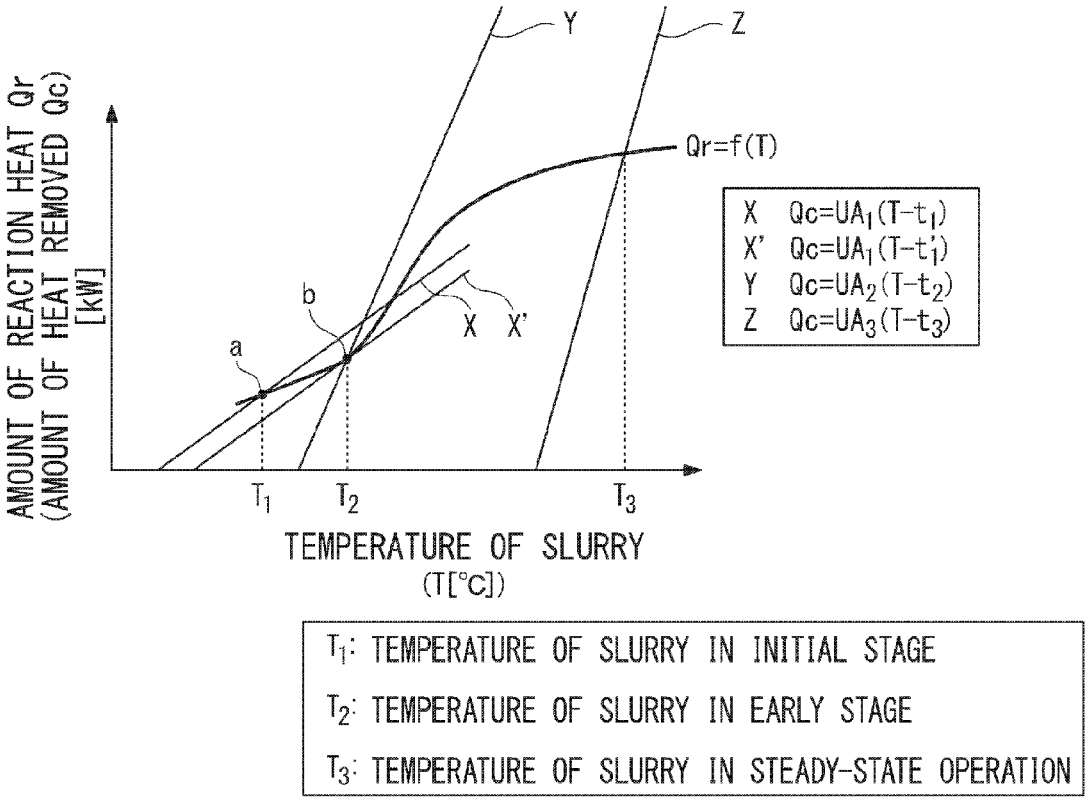
FIG. 4 shows a chart of the relationship between the heat inside of the slurry bubble column reactor and the temperature of the slurry when carrying out the start-up method of the embodiment of the present invention in the hydrocarbon synthesis reaction apparatus shown in FIG. 1.

FIG. 4 shows the relationship between the heat generation rate and the heat removal rate in the reactor 30 when carrying out the start-up method of the FT synthesis unit 5.

FIG. 4 is a chart showing the relationship between the heat inside the reactor and the temperature of the slurry in the case of carrying out the start-up method of the embodiment of the present invention in the hydrocarbon synthesis reaction apparatus shown in FIG. 1.

1) The heat generation rate Qr (kW) which is the rate of the heat generated by synthesizing the hydrocarbon by the FT synthesis reaction is expressed as a function of the reaction temperature T (the temperature of the slurry).

$$Qr=f(T)$$

2) The heat removal rate Qc (kW), which is the rate of the heat removed from the slurry S by the cooling device 46 having the heat exchanger tube 39, is expressed as below;

$$Qc=UA(T-t)$$

wherein U is the overall heat transfer coefficient (kW/m$^2$K), A is the effective area of the heat exchanger tube used to remove the heat from the slurry (m$^2$), T is the temperature of the slurry S (° C.), and t is the temperature of the coolant in the steam drum 44 (° C.).

3) The temperature, in which the heat generation rate and the heat removal rate balances out under the condition that the effective area of the heat exchanger tube is $A_1$ and the reaction temperature is $T_1$, is expressed by $t_1$ (refer to point a in the FIG. 4). In order to increase the temperature of the slurry, the temperature of the coolant in the steam drum is set to a temperature higher than $t_1$, thereby making the heat generation rate larger than the heat removal rate, in the initial stage of the FT synthesis reaction.

4) If the temperature of the slurry S increases slightly from this state, the heat removal rate exceeds the heat generation rate, so that the temperature of the slurry S decrease to return to $T_1$ (refer to X in the FIG. 4). Accordingly, this operating point is stable in that the reaction temperature does not increase rapidly.

5) While the effective area of the heat exchanger tube remains $A_1$, meaning the liquid level of the slurry S remains $h_1$, the temperature of the slurry is set to $T_2$, and the temperature of the coolant in the steam drum is set to the temperature $t_1'$ in which the heat generation rate and the heat removal rate balances out at that time (point b). If the temperature of the slurry S increases slightly from this state, the heat generation rate exceeds the heat removal rate and the temperature of the slurry S increases further, resulting in that the temperature of the slurry increases rapidly (refer to X' in the FIG. 4). That is, the operation is unstable in that the reaction temperature is set to $T_2$ under the condition that the liquid level of the slurry is $h_1$.

6) The FT synthesis reaction proceeds, and the liquid level of the slurry S rises, and then the effective area of the heat exchanger tube reaches $A_2$. Under this condition, the temperature of the slurry is set to $T_2$, and the temperature of the coolant in the steam drum is set to the temperature $t_2$, in which the heat generation rate and the heat removal rate balances out. In such case, if the temperature of the slurry S increases slightly from this state, the temperature of the slurry decreases to return to $T_2$ such as the above-mentioned 4) (refer to Y in the FIG. 4).

7) The condition for stable operation at any temperature T of the slurry is that "a variation of the heat removal rate Qc in response to a variation of the temperature of the slurry exceeds a variation of the heat generation rate Qr of the hydrocarbon synthesis reaction in response to the variation of the temperature of the slurry"; that is, "a first slope of the Qc is more than a second slope of the Qr at the temperature T". The first slope of Qc is product U and A. Since the range of the variation of U due to operation is not wide, the first slope of Qc is determined by A. Consequently, the effective area A of the heat exchanger tube is determined, and then the reaction temperature T, at which the operation of the FT synthesis unit 5 is stable at that time, is determined.

8) The CO conversion ratio, at which the operation of the FT synthesis unit 5 is stable at that time, is determined depending on the liquid level h of the slurry, because of one-to-one correspondence between the effective area A of the heat exchanger tube and the liquid level h of the slurry and between reaction temperature T and the CO conversion ratio.

As described above, in the start-up method of the hydrocarbon synthesis reaction apparatus in the present invention, the slurry is loaded into the reactor at the initial stage of the FT synthesis reaction, wherein the loading rate of the slurry loaded into the reactor is less than that of the slurry to be loaded into the reactor in the steady-state operation of the hydrocarbon synthesis reaction apparatus. Then, the liquid hydrocarbon synthesized by the FT synthesis reaction is added to the slurry at the early stage of the FT synthesis reaction, thereby the rise in the liquid level of the slurry. At this time, the CO conversion ratio increases in proportion to the rise in the liquid level of the slurry; that is, the CO conversion ratio is increased in consideration of the cooling capacity of the heat exchanger tube. In this manner, it is possible to prevent the catalyst particles from thermal deterioration caused by the rapid increase of the temperature of the slurry.

In addition, the loading rate of the slurry loaded into the reactor at the initial stage of FT synthesis reaction is less than that in the steady-state operation of the hydrocarbon synthesis reaction apparatus. Therefore, it is possible to shorten the time to replace the liquid medium in the slurry loaded at the initial stage with liquid hydrocarbon as much as reducing the loading rate of the slurry loaded at the initial stage. Further, the feedstock supplied to the reactor is wasted due to the feedstock not becoming the desired products and is discarded during replacement of the liquid medium. However, since it is possible to shorten the time to replace the liquid medium, it is possible to reduce loss of the feedstock in the initial stage of FT synthesis reaction.

The inventors of the present invention confirmed the effect of the present invention in the following experiment. The start-up method of the FT synthesis unit in the present invention was carried out, wherein the structure shown in FIG. 1 and FIG. 2 was used and the catalyst in which the CO conversion ratio is 19.9 mol/h per 1 kg at 222° C. was used. As a result, an amount of the use of the liquid medium loaded into the reactor at the initial stage of FT synthesis reaction was reduced by 43% compared to the conventional start-up method. The time required to finish replacing the slurry was 41 hours, while the conventional start-up method took 56 hours.

Moreover, the start-up method of the FT synthesis unit in the present invention was carried out, wherein the installation shown in FIG. 1 and FIG. 2 was used, and the catalyst in which the CO conversion ratio was 39.8 mol/h per 1 kg at 222° C. was used. As a result, an amount of the use of the liquid medium loaded into the reactor at the initial stage of FT synthesis reaction was reduced by 48% compared to the conventional start-up method. The time required to finish replacing the slurry was 40 hours, while the conventional start-up method took 54 hours.

Although the preferred embodiments of the present invention have been described with reference to the accompanying drawings, the invention is not limited to the embodiments, and the present invention also includes design changes which do not depart from the spirit of the present invention.

Although the steam drum 44 of the closed type and the heat exchanger tube 39 are used as the cooling device in the above-mentioned embodiment, the cooling device is not limited to this. Any cooling devices in which the heat exchanger tube for cooling the slurry is vertically installed in the reactor are applicable to the present invention, such as a cooling device using the coolant circulating type or passing type, or the cooling device for cooling electrically.

Further, although the temperature at which the Fischer-Tropsch synthesis reaction starts is 150° C. and the temperature in the steady-state operation of the hydrocarbon synthesis reaction apparatus is 220° C. in the embodiment, this is just an example. It is possible to change the temperature arbitrarily in accordance with the type of catalyst used or the conditions of the operation of the hydrocarbon synthesis reaction apparatus.

INDUSTRIAL APPLICABILITY

The present invention relates to a start-up method of a hydrocarbon synthesis reaction apparatus which includes a slurry bubble column reactor. According to the present invention, it is possible to shorten the time of start-up of a hydrocarbon synthesis reaction apparatus and to reduce loss of feedstock in the initial stage of an FT synthesis reaction. Therefore, it is possible to improve the economic performance of a GTL plant and prevent thermal deterioration of a catalyst caused by an increase in temperature of a slurry.

DESCRIPTION OF THE REFERENCE SYMBOLS

3: synthesis gas production unit
5: FT synthesis unit (hydrocarbon synthesis reaction apparatus)
7: upgrading unit
30: slurry bubble column reactor (reactor)
31: synthesis gas supply line
39: heat exchanger tube
43: coolant circulating line
44: steam drum
45: BFW pump
46: cooling device
100: control device
101: liquid level sensor
103: temperature sensor
104: pressure sensor

The invention claimed is:

1. A start-up method of a hydrocarbon synthesis reaction apparatus, wherein the reaction apparatus is provided with a reactor in which a hydrocarbon is synthesized by a Fischer-Tropsch synthesis reaction of a synthesis gas, whose main components are hydrogen and carbon monoxide, with a slurry including a suspension of catalyst particles, and a cooling device including a vertical heat exchanger tube in contact with the slurry used to remove heat generated by the hydrocarbon synthesis reaction, the start-up method comprising:

an initial slurry-loading step in which the slurry is loaded into the reactor at the initial stage of the Fischer-Tropsch synthesis reaction at a lower loading rate than that applied to the reactor in a steady-state operation; and a CO conversion ratio-increasing step in which the liquid level of the slurry in the reactor is raised by adding to the slurry the hydrocarbons synthesized at the early stage of the Fischer-Tropsch synthesis reaction so that the CO conversion ratio is increased in proportion to a rise in the liquid level of the slurry in the reactor.

2. The start-up method of the hydrocarbon synthesis reaction apparatus according to claim 1, wherein the heat removal rate by the cooling device, in removing the heat generated by the hydrocarbon synthesis reaction from the slurry, is calculated from an effective area of the heat exchanger tube throughout the CO conversion ratio-increasing step, and the CO conversion ratio is increased by controlling the temperature of the slurry under the condition that a variation of the heat removal rate in response to a variation of the temperature of the slurry exceeds a variation of the heat generation rate of the hydrocarbon synthesis reaction in response to the variation of the temperature of the slurry.

3. The start-up method of the hydrocarbon synthesis reaction apparatus according to claim 2, wherein the temperature of the coolant flowing through the heat exchanger tube is varied to control the temperature of the slurry throughout the CO conversion ratio-increasing step.

4. The start-up method of the hydrocarbon synthesis reaction apparatus according to claim 1, wherein the temperature of the slurry is maintained in a range of 150° C. to 240° C., throughout the CO conversion ratio-increasing step.

5. The start-up method of the hydrocarbon synthesis reaction apparatus according to claim 2, wherein the temperature of the slurry is maintained in a range of 150° C. to 240° C., throughout the CO conversion ratio-increasing step.

6. The start-up method of the hydrocarbon synthesis reaction apparatus according to claim 3, wherein the temperature of the slurry is maintained in a range of 150° C. to 240° C., throughout the CO conversion ratio-increasing step.

* * * * *